US012006099B2

(12) United States Patent
Oike

(10) Patent No.: US 12,006,099 B2
(45) Date of Patent: Jun. 11, 2024

(54) BAG BODY WITH FITTING TOOL

(71) Applicant: C.I. TAKIRON Corporation, Osaka (JP)

(72) Inventor: Takayuki Oike, Osaka (JP)

(73) Assignee: C.I. TAKIRON CORPORATION, Osaka (JP)

( * ) Notice: Subject to any disclaimer, the term of this patent is extended or adjusted under 35 U.S.C. 154(b) by 0 days.

(21) Appl. No.: 17/418,094

(22) PCT Filed: Dec. 18, 2019

(86) PCT No.: PCT/JP2019/049580
§ 371 (c)(1),
(2) Date: Jun. 24, 2021

(87) PCT Pub. No.: WO2020/137736
PCT Pub. Date: Jul. 2, 2020

(65) Prior Publication Data

US 2022/0112002 A1 Apr. 14, 2022

(30) Foreign Application Priority Data

Dec. 25, 2018 (JP) ..... 2018-241535

(51) Int. Cl.
*B65D 33/25* (2006.01)

(52) U.S. Cl.
CPC ..... *B65D 33/2508* (2013.01)

(58) Field of Classification Search
CPC ..... B65D 33/2508
(Continued)

(56) References Cited

U.S. PATENT DOCUMENTS 4,863,286 A 9/1989 Branson
5,513,915 A 5/1996 May
(Continued)

FOREIGN PATENT DOCUMENTS

CN 1993272 A 7/2007
CN 101041389 A 9/2007
(Continued)

OTHER PUBLICATIONS

Chinese Search Report, dated Jun. 2, 2022, for Chinese Application No. 201980085613.0, 11 pages. (with English translation).
(Continued)

*Primary Examiner* — Jes F Pascua
(74) *Attorney, Agent, or Firm* — Seed IP Law Group LLP

(57) ABSTRACT

The fitting tool (10) includes a first fitting member (12) that includes a first fitting part (18) provided on a strip-shaped first base material (16) in a longitudinal direction of the first fitting member, and a second fitting member (14) that includes a second fitting part (22) provided on a strip-shaped second base material (20) in a longitudinal direction of the second fitting member and is detachably fitted to the first fitting part, the first base material and the second base material each includes an extension part (13, 17) that extends from a first end part (16*c*, 20*c*) in a width direction of the first base material and the second base material to an outer surface side opposite to a facing surface (16*a*, 20*a*), on which the first fitting part or the second fitting part is provided, the extension part facing to the outer surface (16*d*, 20*d*), and a second end part on a side opposite to the first end part is separately arranged from the extension part.

5 Claims, 8 Drawing Sheets

(58) Field of Classification Search
USPC ..... 383/63
See application file for complete search history.

(56) References Cited

U.S. PATENT DOCUMENTS

| | | | | |
|---|---|---|---|---|
| 6,185,796 | B1 | 2/2001 | Ausnit | |
| 7,419,300 | B2 * | 9/2008 | Pawloski | B65D 33/10 383/14 |
| 11,511,914 | B2 | 11/2022 | Hansen et al. | |
| 2003/0099412 | A1 * | 5/2003 | Schneider | B65D 33/2516 383/203 |
| 2006/0003879 | A1 * | 1/2006 | Buchman | B65D 33/2533 493/213 |
| 2006/0062495 | A1 * | 3/2006 | Plourde | B65B 9/20 383/203 |
| 2007/0183692 | A1 * | 8/2007 | Pawloski | B65D 33/2566 383/63 |
| 2008/0089618 | A1 * | 4/2008 | Blythe | B65D 33/08 383/25 |
| 2009/0226119 | A1 | 9/2009 | Hatakeyama | |
| 2012/0321225 | A1 | 12/2012 | Goto | |
| 2014/0161374 | A1 | 6/2014 | Septien Rojas et al. | |
| 2016/0194117 | A1 | 7/2016 | Goto et al. | |
| 2016/0311580 | A1 | 10/2016 | Ozaki et al. | |
| 2017/0190476 | A1 | 7/2017 | Goto et al. | |
| 2017/0275055 | A1 * | 9/2017 | Martial | B65D 33/2541 |
| 2018/0118414 | A1 * | 5/2018 | Martial | B65D 33/2541 |
| 2018/0184767 | A1 | 7/2018 | Oike et al. | |

FOREIGN PATENT DOCUMENTS

| | | | |
|---|---|---|---|
| CN | 105377706 | A | 3/2016 |
| CN | 106335699 | A | 1/2017 |
| CN | 106335700 | A | 1/2017 |
| DE | 1776769 | U | 10/1958 |
| JP | 2003-502181 | A | 1/2003 |
| JP | 2004-026193 | A | 1/2004 |
| JP | 2011-177215 | A | 9/2011 |
| JP | 2013139278 | A | 7/2013 |
| JP | 2015-217980 | A | 12/2015 |
| JP | 2015-224036 | A | 12/2015 |
| JP | 2016-043973 | A | 4/2016 |
| JP | 2016-088531 | A | 5/2016 |
| JP | 2018-512342 | A | 5/2018 |
| WO | 2000/076872 | A1 | 12/2000 |
| WO | 2019/172558 | A1 | 9/2019 |

OTHER PUBLICATIONS

European Search Report, dated Aug. 26, 2022, for European Application No. 19901799.7, 7 pages.
International Search Report, dated Mar. 10, 2020, for International Application No. PCT/JP2019/049580, 6 pages.
Notice of Allowance, dated Feb. 4, 2024, for a corresponding Chinese Application No. 201980085613.0 8 pages.

* cited by examiner

BAG BODY WITH FITTING TOOL

TECHNICAL FIELD

The present invention relates to a fitting tool and a bag body with the fitting tool. Priority is claimed on Japanese Patent Application No. 2018-241535, filed Dec. 25, 2018, the content of which is incorporated herein by reference.

BACKGROUND ART

A bag body with a fitting tool is widely used in various fields such as food, medicine, and miscellaneous goods. In a bag body with a fitting tool, the fitting tool that seals an opening portion in an openable and closable manner is attached to an inner surface of the bag body in the vicinity of the opening portion. As a fitting tool, an example in which a first fitting part and a second fitting part that are detachably fitted to each other are provided along longitudinal directions of a pair of strip-shaped base materials, and the pair of base materials are disposed and fitted to face each other can be exemplified. For example, a removable fitting tool in which both a first fitting part and a second fitting part have a plurality of parallel male claw portions, and head portions of the male claw portions are respectively inserted and hooked between two male claw portions that face each other and these are fitted to each other is known.

In such a bag body with a fitting tool, the opening portion formed in the bag body can be closed by fitting the first fitting part and the second fitting part of the fitting tool. By gripping each opening end of a bag main body to which the fitting tool is attached and pulling them in directions in which they are separated to release the fitting between the first fitting part and the second fitting part, the bag body can be opened again. In this way, the bag body with the fitting tool can be repeatedly opened and closed.

For example, in a case in which packaged items such as cigarettes, alcohol-containing foods, chemicals, and the like are stored in a bag body with a fitting tool, it is desirable to store them in a place that is out of the reach of those who lack the ability to judge, such as infants and children. However, those who lack the ability to judge may mistakenly touch the bag body with a fitting tool in which such packaged items are stored. Since a conventional bag body with a fitting tool is configured to be easily operable and closable, anyone can easily open it. For that reason, a bag body with a fitting tool in which packaged items that are not to be touched by an infant, a child, or the like are stored may also be easily opened. Therefore, there is demand for a bag body with a fitting tool that can be opened repeatedly but cannot be easily opened by an infant or a child. For example, Patent Document 1 discloses a packaging bag provided with a zipper having a child resistance function so that a child or the like cannot easily open the bag.

CITATION LIST

Patent Document

[Patent Document 1]
Japanese Unexamined Patent Application, First Publication No. 2016-88531

SUMMARY OF INVENTION

Technical Problem

The packaging bag described in Patent Document 1 is provided with a lock region having a child resistance function at a part of an opening portion of the packaging bag, and a release region for easy release at left and right end portions of the lock region. The release region is configured such that it can be easily opened by inserting a finger above a fitting part. For that reason, even a child or the like is able to open the packaging bag by inserting a finger into the release region. Specifically, in the release region of the packaging bag of Patent Document 1, it has been proposed to provide a member for forming a tongue piece shape that is integrated with an adhesive band body and extends toward an opening portion side at either or both of left and right end portions of a bottom surface adhesion fitting body. For example, it has been proposed to provide a tongue piece-shaped member by cutting out a central part of the adhesive band body along the fitting part, or by adhering a separate release piece to the left and right end portions of the adhesive band body. In any case, when the packaging bag is manufactured, an additional step is required after attaching the zipper to the bag body. For this reason, this may cause a decrease in production efficiency and a deterioration in yield.

The present invention has been made in view of the above circumstances, and an object of the present invention is to provide a fitting tool that can be repeatedly opened while preventing inadvertent opening caused by an infant, a child, or the like, and a bag body with the fitting tool.

Solution to Problem

The present invention has the following configurations.

[1] A fitting tool including: a first fitting member that includes a first fitting part provided on a first base material having a strip-shape in a longitudinal direction of the first fitting member; and a second fitting member that includes a second fitting part that is provided on a second base material having a strip-shape in a longitudinal direction of the second fitting member and is detachably fitted to the first fitting part, wherein the first base material and the second base material each include an extension part that extends from a first end part in a width direction of the first base material and the second base material to an outer surface side opposite to a facing surface, on which the first fitting part or the second fitting part is provided, the extension part facing to the outer surface, wherein a second end part on a side opposite to the first end part is separately arranged from the extension part.

[2] The fitting tool according to [1], wherein, in a state in which the first fitting part and the second fitting part are fitted, a position of the first end part of the first base material and a position of the first end part of the second base material coincide with each other.

[3] The fitting tool according to [1] or [2], wherein, in the first fitting member and the second fitting member, a length from the first end part to an extension end of the extension part is longer than a length from the first end part to the first fitting part or the second fitting part.

[4] The fitting tool according to any one of [1] to [3], wherein, in at least one of the first fitting member and the second fitting member, a width of the extension part is longer than a width of the first base material or the second base material.

[5] The fitting tool according to any one of [1] to [4], wherein a fitted state between the first fitting part and the second fitting part is configured to be releasable by applying a force in a direction in which the first base material and the second base material are separated from each other from the fitted state in which the first fitting part and the second fitting part are fitted, and a force required to release the fitted state is such that a force that separates the first end parts from each other to release the fitted state is greater than a force that separates the second end parts from each other to release the fitted state.

[6] A bag body with a fitting tool including: a bag main body which includes a storage portion for storing contents; and the fitting tool according to any one of [I] to [5] which is attached to a vicinity of an opening portion on an inner surface of the bag main body to be able to seal the bag main body, wherein at least a part of the extension part is fixed to the inner surface of the bag main body, and the second end part is provided on an opening portion side of the bag main body with respect to the first end part.

[7] The bag body with the fitting tool according to [6], wherein the extension part extends toward the opening portion side with respect to the second end part, an extension end of the extension part is fixed to the inner surface of the bag main body, and the first end part is provided to be separable from the inner surface of the bag main body.

[8] A bag body with a fitting tool including: a bag main body that includes a storage portion for storing contents; and a fitting tool attached to a vicinity of an opening portion on an inner surface of the bag main body to be able to seal the bag main body, wherein the fitting tool includes a first fitting member that includes a first fitting part provided on the inner surface of the bag main body in the vicinity of the opening portion and provided on a first base material having a strip-shape in a longitudinal direction of the first fitting member, and a second fitting member that includes a second fitting part provided on the inner surface of the bag main body in the vicinity of the opening portion to face the first fitting member and provided on a second base material having a strip-shape in a longitudinal direction of the second base material and is detachably fitted to the first fitting part, a part of an outer surface of each first end part located on a storage portion side in width directions of the first base material and the second base material is fixed to the inner surface of the bag main body, a second end part on a side opposite to the first end part located on an opening portion side is separately arranged from the inner surface of the bag main body, a fitted state between the first fitting part and the second fitting part is configured to be releasable by applying a force in a direction in which the first base material and the second base material are separated from each other from the fitted state in which the first fitting part and the second fitting part are fitted, and a force required to release the fitted state is configured such that a force that separates the first end parts from each other to release the fitted state is greater than a force that separates the second end parts from each other to release the fitted state.

Advantageous Effects of Invention

A fitting tool and a bag body with the fitting tool that are repeatedly opened while preventing inadvertent opening caused by an infant, a child, or the like, is capable of being provided.

DESCRIPTION OF EMBODIMENTS

[Fitting Tool]

Hereinafter, a fitting tool according to a first embodiment of the present invention will be described with reference to FIGS. 1 to 3.

Figure 1:
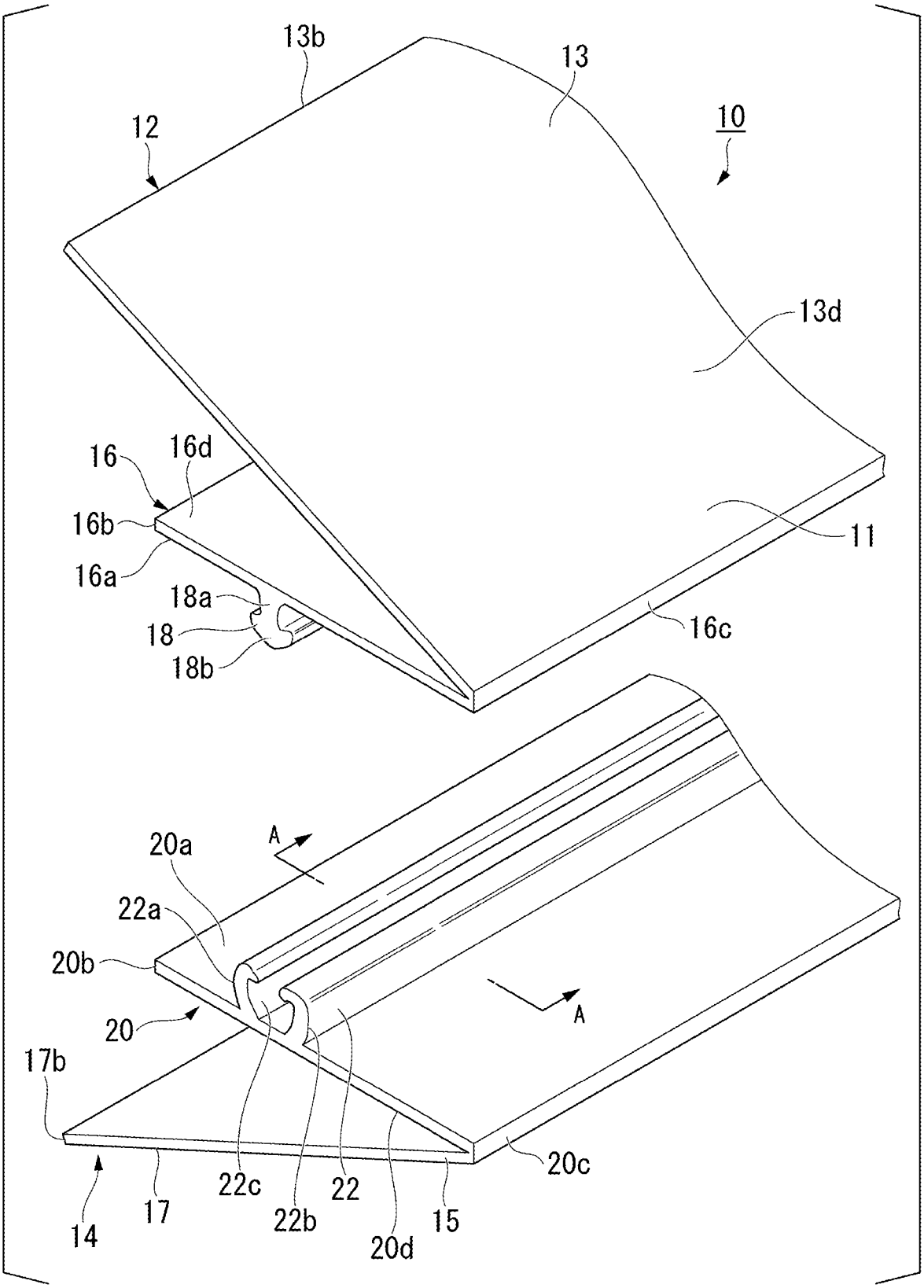
FIG. 1 is a perspective view showing a fitting tool according to a first embodiment of the present invention.
Figure 2:
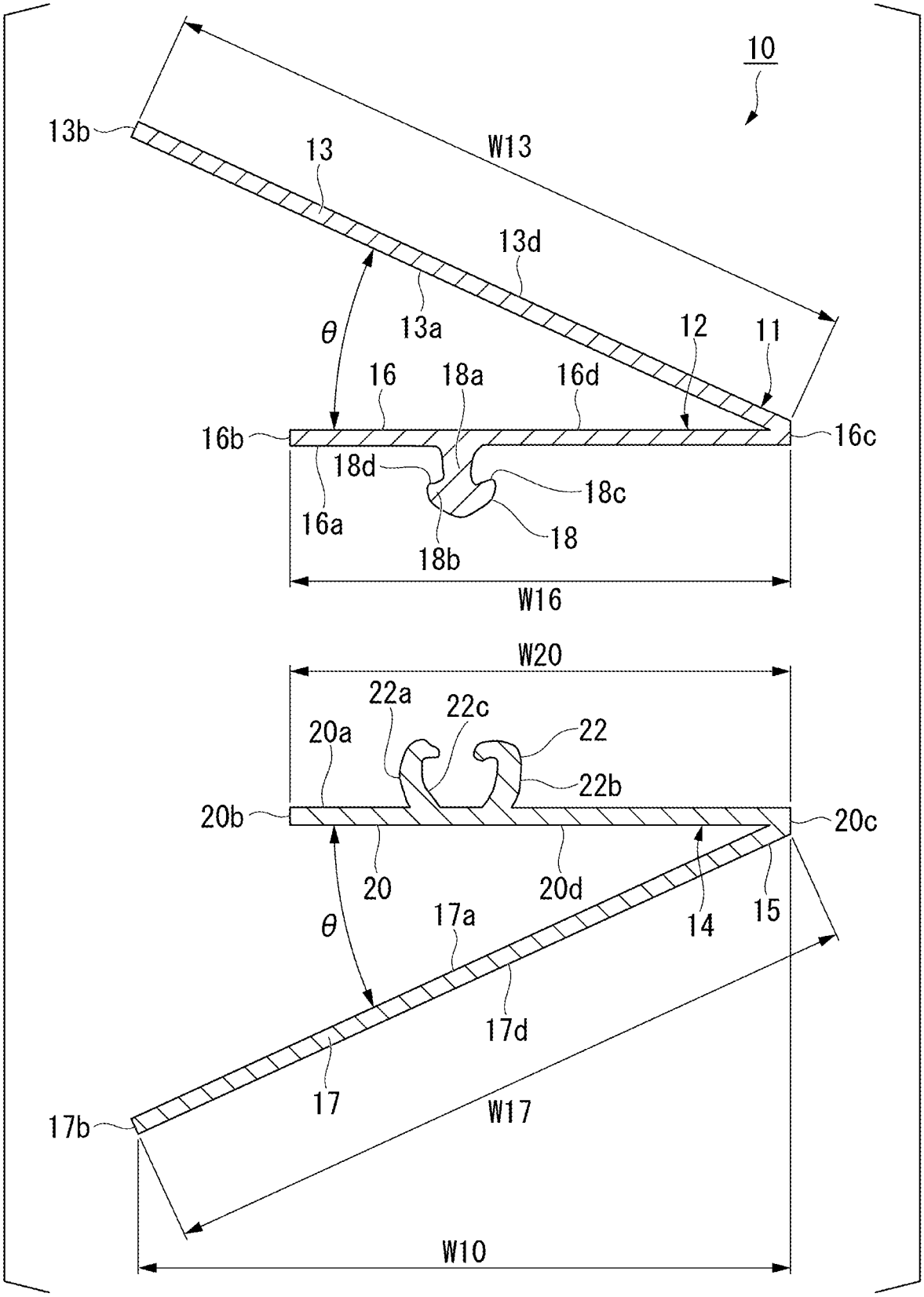
FIG. 2 is a cross-sectional view along line A-A in FIG. 1.
Figure 3:
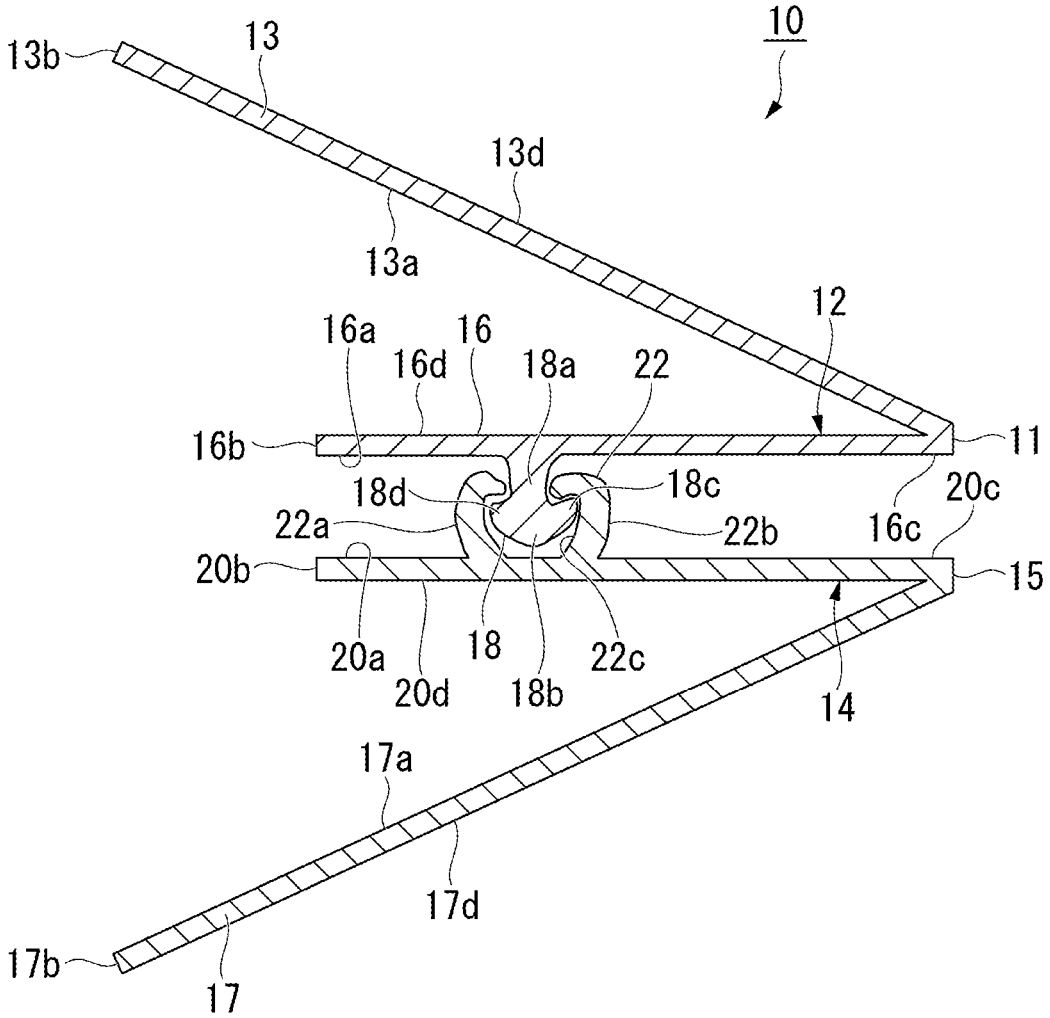
FIG. 3 is a cross-sectional view in a state in which the fitting tool according to the first embodiment of the present invention is fitted.

As shown in FIGS. 1 to 3, a fitting tool 10 according to the present embodiment includes a first fitting member 12 and a second fitting member 14, which have strip shapes. The fitting tool 10 is configured such that a first fitting part 18 of the first fitting member 12 and a second fitting part 22 of the second fitting member 14 are disposed to face each other and are detachably fitted to each other. The fitting tool 10 is used by being attached to a vicinity of an opening portion of a bag body with a fitting tool, which will be described later, so that the opening portion is sealable.

(First Fitting Member)

The first fitting member 12 has a first base material 16, a first fitting part 18, and a first extension part 13 that have strip-shaped. The first fitting part 18 and the first extension part 13 extend in a longitudinal direction of the first base material 16.

The first base material 16 is not particularly limited, and those used for base materials for known fitting tools may be used therefor. For example, polyolefin-based resins such as ethylene-based polymers and propylene-based polymers can be exemplified. The first base material 16 is preferably a base material made of a laminated film. As the laminated film, a film in which a heat-resistant layer and a heat-sealing layer are laminated from a facing surface **16*a* side facing a second base material 20 can be exemplified. The first base material 16** may have a barrier layer between the heat-resistant layer and the heat-sealing layer.

As a material of the heat-resistant layer, biaxially stretched nylon, biaxially stretched polypropylene, and the like can be exemplified.

As a material of the heat seal layer, linear low-density polyethylene, unstretched polypropylene, ethylene-vinyl acetate copolymer, ionomers and the like can be exemplified.

As a material of the barrier layer, polyvinyl alcohol and the like can be exemplified.

The first base material 16 may be made of one kind of resin or may be made of a resin composition containing two or more kinds of resins. If necessary, known additives such as stabilizers, antioxidants, lubricants, antistatic agents, and colorants may be added.

The first base material 16 is not limited to a base material configured of a laminated film and may be a base material configured of a single-layer film.

In addition, at least a part of each of the first base material 16 and the second base material 20 may be provided with a resin layer having an easy-to-cut function. A polyolefin-based resin composition is used for the resin layer having an easy-to-cut function. As crystalline polyolefin resins constituting the polyolefin-based resin composition, ethylene-based polymers and propylene-based polymers can be exemplified. As the ethylene-based polymers, which are not particularly limited, ethylene homopolymers, ethylene•α-olefin copolymers, ethylene-vinyl acetate copolymers, ethylene-acrylic acid-based copolymers, copolymers with metal salts thereof, and the like can be exemplified. As the propylene-based polymers, propylene homopolymers, random copolymers or block copolymers of propylene and ethylene or other olefins having 4 or more carbon atoms, and the like can be exemplified. The resin layer having an easy-to-cut function may be provided over the entire region of the first base material 16 and the second base material 20.

As shown in FIGS. 1 to 3, the first fitting part 18 is provided on the facing surface 16*a* of the first base material 16, which faces the second base material 20 of the second fitting member 14, in the longitudinal direction of the first base material 16.

The first fitting part 18 includes a trunk portion 18*a* that rises from the facing surface 16*a* of the first base material 16, and a head portion 18*b* that is provided on a tip end side of the trunk portion 18*a* and is larger than the trunk portion 18*a*. The first fitting part 18 is a male fitting part and is configured such that the head portion 18*b* is fitted into a recessed portion 22*c* of the second fitting part 22, which will be described later.

The head portion 18*b* in the first fitting part 18 of this example has a shape in which a portion 18*c* on a second side end 16*b* (a second end part) side protrudes to be longer than a portion 18*d* on a first side end 16*c* side. With this configuration, in a state in which the first fitting part 18 and the second fitting part 22 are fitted to each other in the bag body as described later, a fitting strength on the storage portion side in which the contents are stored becomes greater than that on the opening portion side. Thus a fitting between the first fitting part 18 and the second fitting part 22 is difficult to be released even if an internal pressure of the bag body increases. The fitting strength is relatively low on the opening portion side, and thus the fitting between the first fitting part 18 and the second fitting part 22 is easily released by applying a force by hand.

A shape of the first fitting part 18 may be any shape that is capable of being fitted to the second fitting part 22, and a known shape may be adopted therefor. A material of the first fitting part 18 is not particularly limited and for example, the same materials as for the first base material 16 may be used.

As shown in FIGS. 1 to 3, the first fitting member 12 has the first extension part 13. The first extension part 13 is provided such that the first extension part 13 having a flat plate shape extends in the longitudinal direction in a strip shape. The first extension part 13 faces an outer surface 16*d* side opposite to the facing surface 16*a* of the first base material 16. The first extension part 13 is provided to extend continuously from the first side end 16*c* side, which is one end part in the width direction of the first base material 16, to the outer surface 16*d* side. A folded first folded portion 11 is formed at a boundary part between the first extension part 13 and the first base material 16. In the present embodiment, the first folded portion 11 is bent such that an angle θ formed by the outer surface 16*d* of the first base material 16 and an inner surface 13*a* of the first extension part 13 facing the outer surface 16*d* is an acute angle. However, the first end part 16*c* of the first base material 16 and the first extension part 13 may be connected with each other in a curved manner.

As shown in FIG. 2, a width W13 of the first extension part 13 is longer than a width W16 of the first base material 16. In the first extension part 13, a first extension end 13*b* on a side opposite to the first side end 16*c* is located on the second side end 16*b* side from the first fitting part 18 of the first base material 16 in a width direction W10 of the fitting tool 10. In the present embodiment, the first extension end 13*b* extends to be longer than the second side end 16*b* of the first base material 16 in the width direction W10 of the fitting tool 10.

As shown in FIG. 2, the first extension end 13*b* of the first extension part 13 is located to be closer to the second side end 16*b* than to the first fitting part 18. That is, in the first fitting member 12, a length from the first side end 16*c* to the first extension end 13*b* of the first extension part 13 is longer than a length from the first side end 16*c* to the trunk portion 18*a* of the first fitting part 18 in the width direction W10 of the fitting tool 10.

The first extension part 13 is preferably a laminated film having at least a base layer and a sealant layer, for example. For the base layer, biaxially stretched nylon, biaxially stretched polypropylene, and the like can be exemplified. As the sealant layer, linear low-density polyethylene, unstretched polypropylene, ethylene-vinyl acetate copolymer, ionomers, and the like can be exemplified. The first extension part 13 may be further provided with a functional layer such as a barrier layer. Alternatively, the first extension part 13 may be a single-layer film configured of only the sealant layer.

(Second Fitting Member)

The second fitting member 14 has a second base material 20, a second fitting part 22, and a second extension part 17 that have a strip-shape. The second fitting part 22 and the second extension part 17 extend in a longitudinal direction of the second base material 20. The second fitting member 14 has the same configurations as those of the first base material 16, the first folded portion 11, and the first extension part 13 of the first fitting member 12. That is, the structure of the second fitting part 22 of the second fitting member 14 is different from that of the first fitting part 18, but shapes of other parts are the same as those of the first fitting member 12.

A material constituting the second base material 20 is not particularly limited, and a base material having the same configuration as the first base material 16 can be exemplified, and the same preferred aspects can also be adopted therefor.

As shown in FIGS. 1 to 3, the second fitting part 22 is provided on a facing surface 20*a* that faces the first base material 16 of the first fitting member 12. The second fitting part 22 includes a pair of first arm portions 22*a* and a second arm portion 22*b* that rise from the facing surface 20*a* of the second base material 20 in an arc shape in cross-section. The second fitting part 22 is formed with the recessed portion 22*c* extending in the longitudinal direction of the second base material 20 between the first arm portion 22*a* and the second arm portion 22*b*.

As shown in FIG. 3, the head portion 18*b* of the first fitting part 18 is fitted into the recessed portion 22*c* of the second fitting part 22, and the head portion 18*b* of the first fitting part 18 is locked at respective tip portions of the first arm portion 22*a* and the second arm portion 22*b* of the second fitting part 22, whereby the first fitting part 18 and the second fitting part 22 are fitted together. By moving the first fitting part 18 in the fitted state in a direction away from the second fitting part 22, the head portion 18*b* of the first fitting part 18 is detached while pushing and widening the first arm portion 22*a* and the second arm portion 22*b* of the second fitting part 22 from the inside. In this way, the first fitting part 18 and the second fitting part 22 are configured to be detachably fitted to each other.

A shape of the second fitting part 22 may be any shape as long as an opening portion of a bag main body is repeatedly opened and closed by attaching and detaching the first fitting part 18 and the second fitting part 22 to and from each other.

A material of the second fitting part 22 is not particularly limited, and for example, the same material as the first base material 16 may be used.

As shown in FIGS. 1 to 3, the second fitting member 14 has the second extension part 17. The second extension part 17 *i* has a flat plate shape and extends in the longitudinal direction in a strip shape. The second extension part 17 faces an outer surface 20*d* side opposite to the facing surface 20*a* of the second base material 20. The second extension part 17 is provided to extend continuously from a first side end 20*c* side, which is one end part in a width direction of the second base material 20, to the outer surface 20*d* side of the second base material 20. A folded second folded portion 15 is formed at a boundary part between the second extension part 17 and the second base material 20. In the present embodiment, the second folded portion 15 is bent such that an angle θ formed by the outer surface 20*d* of the second base material 20 and an inner surface 17*a* of the second extension part 17 that faces the outer surface 20*d* becomes an acute angle. However, the first side end 20*c* of the second base material 20 and the second extension part 17 may be connected to each other in a curved manner.

As shown in FIG. 2, a width W17 of the second extension part 17 is longer than a width W20 of the second base material 20. In the second extension part 17, in the width direction W10 of the fitting tool 10, a second extension end 17*b* on a side opposite to the second folded portion 15 is located to be closer to a second side end 20*b* (a second end part) than to the second fitting part 22 of the second base material 20. In the present embodiment, the second extension end 17*b* extends longer than the second side end 20*b* of the second base material 20 in the width direction W10 of the fitting tool 10.

As shown in FIG. 2, the first extension end 17*b* of the second extension part 17 is located to be closer to the second side end 20*b* than to the second fitting part 22. That is, in the second fitting member 14, a length from the first side end 20*c* to the second extension end 17*b* of the second extension part 17 is longer than a length from the first side end 20*c* to the second arm portion 22*b* of the second fitting part 22 in the width direction W10 of the fitting tool 10.

As shown in FIG. 3, in a state in which the first fitting part 18 and the second fitting part 22 are fitted to each other, a position of the first side end 16*c* of the first base material 16 and a position of the first side end 20*c* of the second base material 20 in the width direction W10 of the fitting tool 10 coincide with each other.

The first extension part 13 and the second extension part 17 are connected to the first base material 16 and the second base material 20, respectively, with the folded portions 11 and 15 as boundaries. On the other hand, the first extension part 13 and the second side end 16*b* of the first base material 16 are separately arranged from each other, and the second extension part 17 and the second side end 20*b* of the second base material 20 are separately arranged from each other. The first extension part 13 and the second extension part 17 are configured to elastically deform starting from the folded portions 11 and 15 and to be movable in a nearing or separating direction with respect to the first base material 16 or the second base material 20. That is, the second side ends 16*b* and 20*b* and the extension parts 13 and 17 are disposed separated from each other. The separate arrangement referred to herein indicates a state in which the second side ends 16*b* and 20*b* and the extension parts 13 and 17 are not adhesively fixed and are arranged so as to abut or to be separated from each other and includes a state in which they are arranged apart from each other and a state in which they are pushed by an external force to abut each other.

In the state in which the first fitting part 18 and the second fitting part 22 are fitted to each other, the first extension part 13 is movable between a state in which the first extension part 13 faces the outer surface 16*d* of the first base material 16 of the first fitting member 12 to be in close proximity thereto and a state in which the first extension part 13 is separated from the outer surface 16*d*. Similarly, in the state in which the first fitting part 18 and the second fitting part 22 are fitted to each other, the second extension part 17 is movable between a state in which the second fitting part 22 faces the outer surface 20*d* of the second base material 20 of the second fitting member 14 be in close proximity thereto and a state in which the second fitting part 22 is separated from the outer surface 20*d*.

The first fitting part 18 and the second fitting part 22 are configured such that the fitted state is capable of being released when a force is applied in a direction of separating the first base material 16 from the second base material 20. Specifically, when a user grips the second side ends 16*b* and 20*b* of the first base material 16 and the second base material 20 with fingers and widens them in a direction in which the facing surfaces 16*a* and 20*a* are separated from each other, the first fitting part 18 is detached from the second fitting part 22, and the fitting state is released. When an external force is applied to the first side ends 16*c* and 20*c* and the facing surfaces 16*a* and 20*a* of the first base material 16 and the second base material 20 move in a direction in which they are separated from each other, the first fitting part 18 may also be detached from the second fitting part 22. However, with respect to the force required to release the fitted state between the first fitting part 18 and the second fitting part 22, a force that separates the first side ends 16*c* and 20*c* from each other to release the fitted state of the fitting parts 18 and 22 is greater than a force that separates the second side ends 16*b* and 20*b* from each other to release the fitting state of the fitting parts 18 and 22. Therefore, the fitting between the fitting parts 18 and 22 are not easily released even if an external force is applied to the first side ends 16*c* and 20*c*.

A method for manufacturing the fitting tool of the present invention is not particularly limited, and a known method may be used therefor. As a method for manufacturing the first fitting member 12 and the second fitting member 14, extrusion molding and the like can be exemplified.

According to the fitting tool 10 in the present embodiment, the first fitting member 12 and the second fitting member 14 include the extension parts 13 and 17, and the second side ends 16*b* and 20*b* are separated from the extension parts 13 and 17, and thus when the user grips the second side ends 16*b* and 20*b* and separates them from each other, the fitted state is easily released. On the other hand, in order for the user to grip and separate the extension ends 13*b* and 17*b* from each other to release the fitted state, a separated distance between the extension ends 13*b* and 17*b* needs to be a predetermined amount or more. Therefore, when such a fitting tool 10 is provided in the opening portion of the bag body, it is possible to provide a fitting tool that is repeatedly opened while preventing inadvertent opening caused by an infant, a child, or the like.

According to the fitting tool 10 in the present embodiment, even when the extension ends 13*b* and 17*b* are gripped and separated from each other, the fitting between the fitting parts 18 and 22 are difficult to be released, and it is difficult for an infant, a child, or the like to open it. In addition, the fitting between the fitting parts 18 and 22 is capable of being released by gripping and separating the second side ends 16*b* and 20*b* from each other, which are difficult for an infant, a child, or the like to operate. That is, the fitting tool 10 has a function of preventing opening caused by an infant, a child, or the like and a function of releasing the fitting between the fitting parts 18 and 22 by gripping and separating the second side ends 16*b* and 20*b* from each other in the same region in the longitudinal direction.

When the fitting tool 10 according to the present embodiment is attached to the opening portion of the bag body, the bag body with the fitting tool that is opened repeatedly while preventing inadvertent opening caused by an infant, a child, or the like is easily manufactured. Since the fitting tool 10 according to the present embodiment has a child resistance function and an opening function executed by an operation of gripping the second side ends 16*b* and 20*b* in the same region in the longitudinal direction, a step of setting the child resistance function after attaching it to the opening portion of the bag body becomes unnecessary. As a result, a bag body with a fitting tool having a child resistance function can be easily manufactured.

[Bag Body with Fitting Tool]

Hereinafter, as a bag body with a fitting tool according to the present embodiment, a bag body 1 with a fitting tool including the above-mentioned fitting tool 10 (hereinafter, may be referred to as the "bag body 1") will be described.

In the present embodiment, a shape of a bag main body 40 is rectangular. The shape of the bag main body 40 is not limited to a rectangle. A size of the bag main body 40 is not particularly limited, and the shape and the size may be appropriately selected depending on the contents to be accommodated in the bag main body 40.

Figure 4:
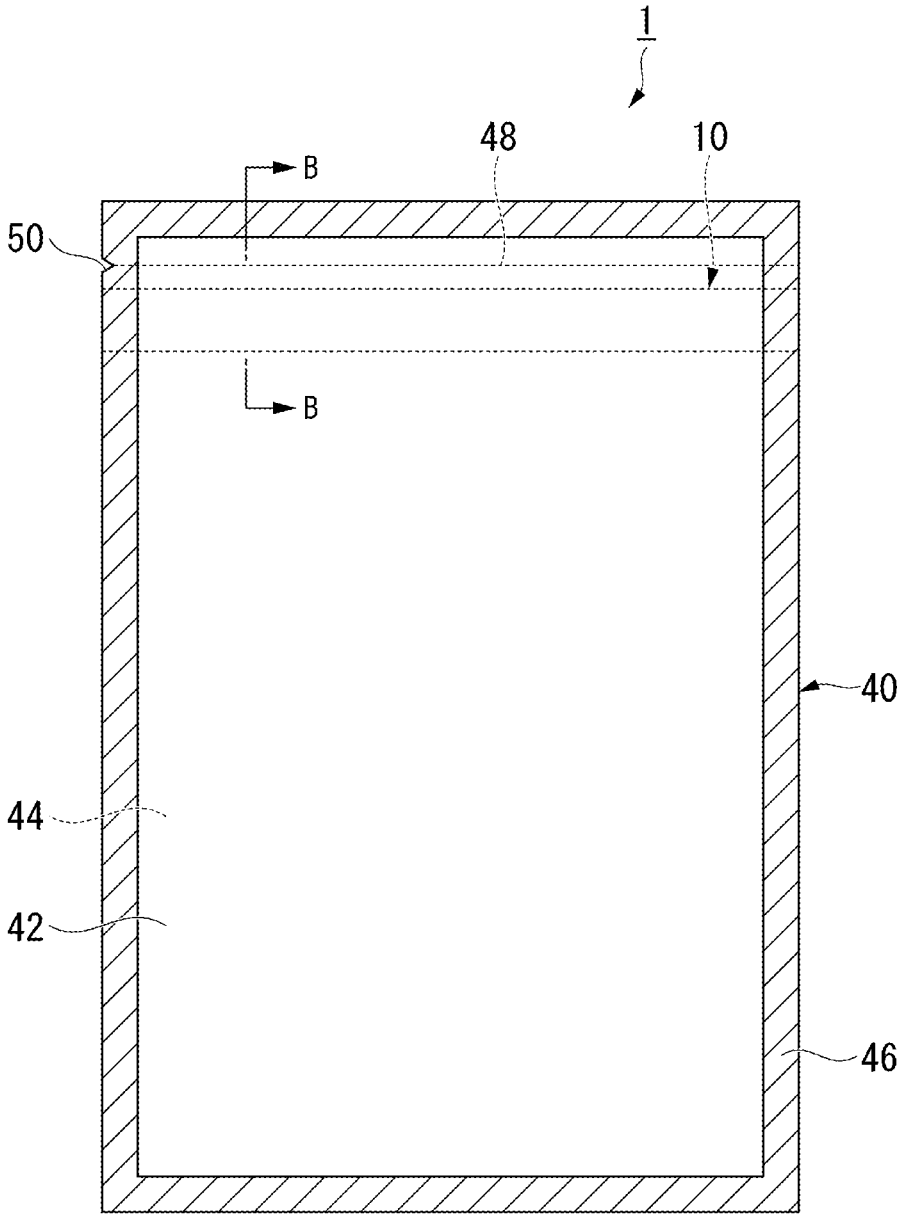
FIG. 4 is a front view of a bag body with the fitting tool according to the first embodiment of the present invention.

As shown in FIG. 4, the bag body 1 includes the bag main body 40 in a sealed state to store the contents, and the fitting tool 10 attached to an inner surface of an upper portion of the bag main body 40 in a lateral direction thereof.

The bag main body 40 is formed and sealed by superimposing a first film material 42 and a second film material 44 and heat-sealing all of peripheral edges 46 of the film materials 42 and 44. A portion below the fitting tool 10 of the bag main body 40 is a storage portion 47 for storing the contents. A portion above the fitting tool 10 in the bag main body 40 becomes an opening portion 52 after the bag body 1 opens. That is, the fitting tool 10 is attached in the vicinity of the opening portion 52 of the bag main body.

The first film material 42 and the second film material 44 forming the bag main body 40 may be any material as long as the fitting tool 10 is capable of being welded by heat-sealing and are preferably laminated films each having at least a sealant layer and a base material layer from an inner surface side thereof.

As the base material layer, biaxially stretched nylon, biaxially stretched polypropylene, and the like can be exemplified.

As the sealant layer, linear low-density polyethylene, unstretched polypropylene, ethylene-vinyl acetate copolymer, ionomers, and the like can be exemplified.

The laminated film may be provided with a functional layer such as a barrier layer. Each of the first film material 42 and the second film material 44 may be a single-layer film configured of only a sealant layer.

Figure 6:
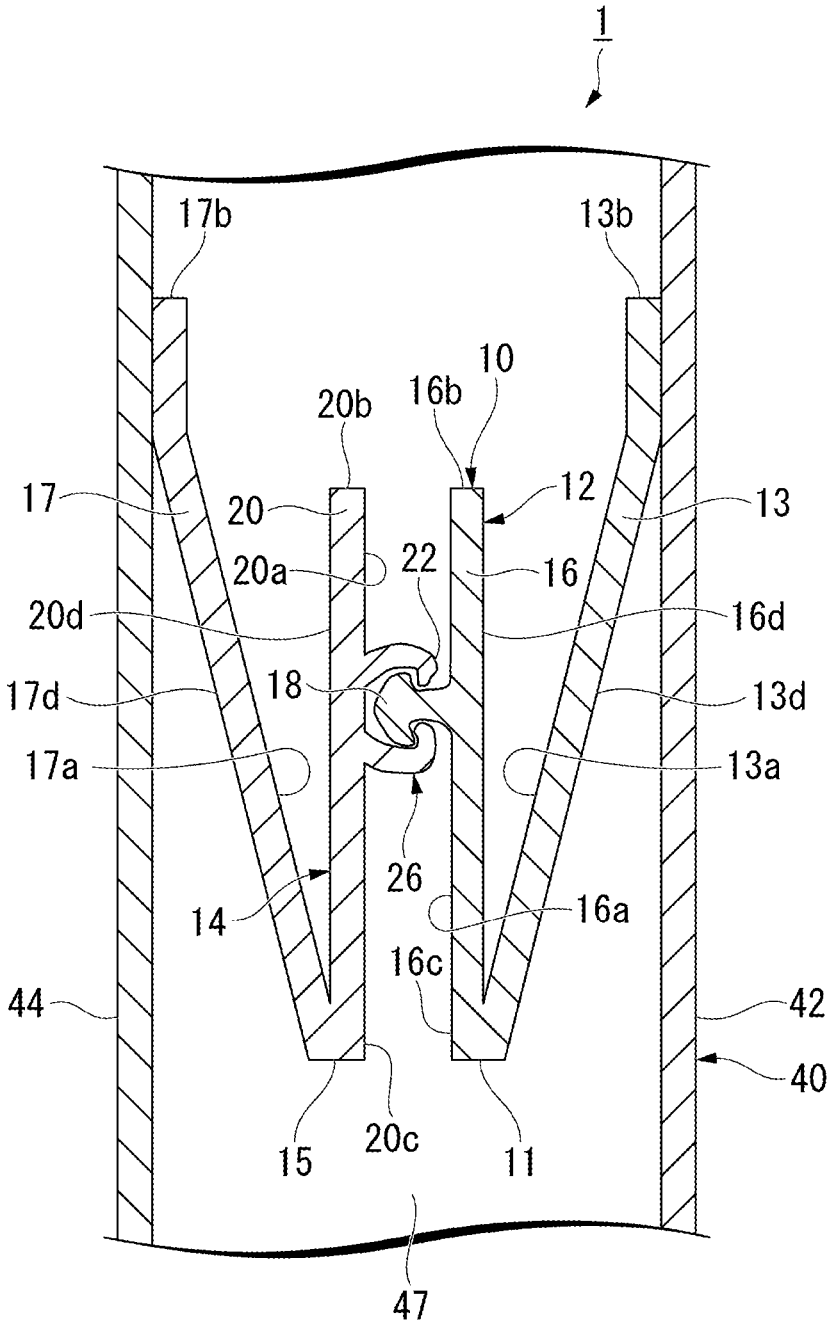
FIG. 6 is a cross-sectional view along line B-B in FIG. 4.

In the bag body 1, as shown in FIG. 6, an outer surface 13*d* of the first extension end 13*b* of the first extension part 13 is welded to the first film material 42 of the bag main body 40, and an outer surface 17*d* of the second extension end 17*b* of the second extension part 17 is welded to the second film material 44 of the bag main body 40, whereby the fitting tool 10 is fixed to the inner surface of the bag main body 40.

In the fitting tool 10, the second side end 16*b* of the first base material 16, the first extension end 13*b* of the first extension part 13, the second side end 20*b* of the second base material 2012, and the second extension end 17*b* of the second extension part 17 are disposed on the opening portion 52 side of the bag body 1, and the first side ends 16*c* and 20*c* are disposed on the storage portion 47 side of the bag body 1.

As shown in FIG. 6, the first fitting member 12 and the second fitting member 14 are disposed such that the first fitting part 18 and the second fitting part 22 face each other. In a state in which the first fitting member 12 and the second fitting member 14 are fitted to each other, the pair of base materials 16 and 20 and the pair of extension parts 13 and 17 are symmetrically disposed with the first fitting member 12 and the second fitting member 14 interposed therebetween.

Figure 5:
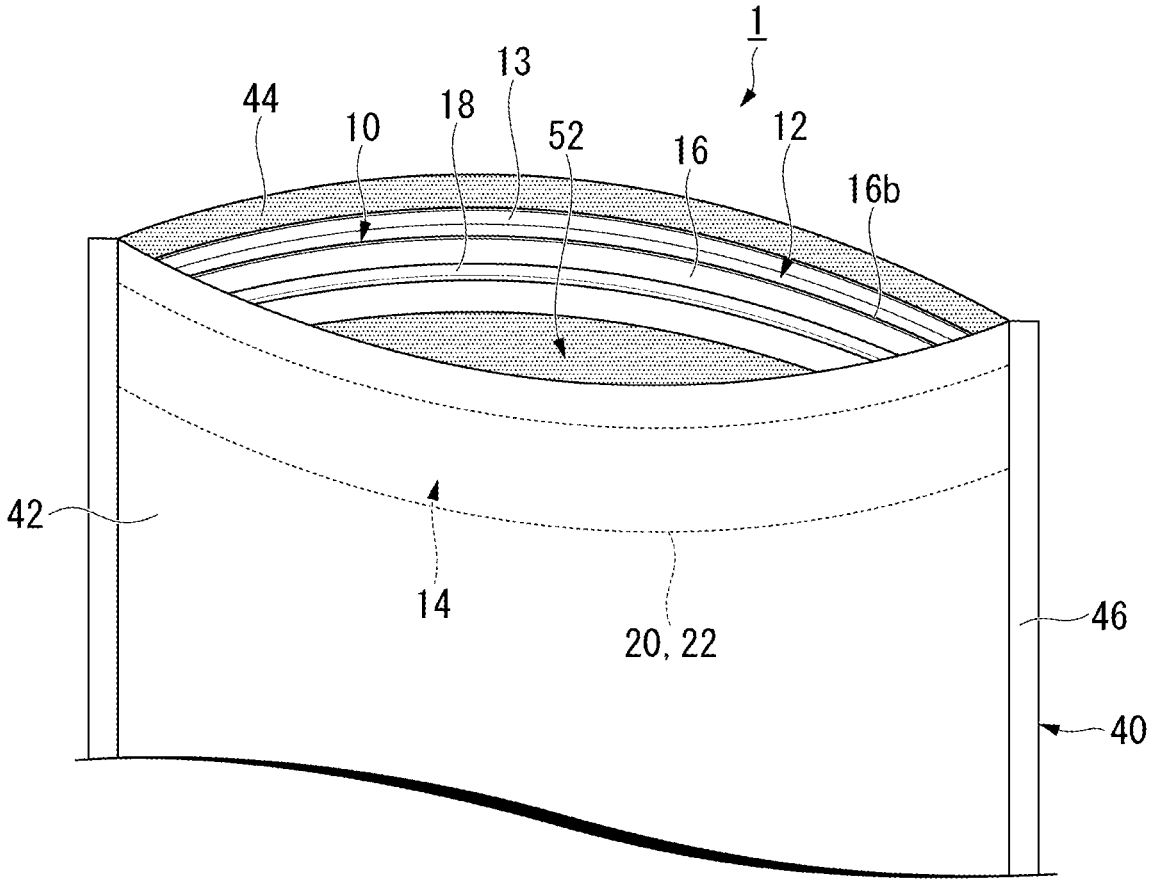
FIG. 5 is a perspective view of an opening portion of the bag body with the fitting according to the first embodiment of the present invention.

As shown in FIG. 5, the fitting tool 10 is disposed in a W shape in a vertical cross-section of the bag body 1. Each of the outer surface 13*d* of the first extension end 13*b* and the outer surface 17*d* of the second extension end 17*b* are welded to the film materials 42 and 44 of the bag main body 40, respectively. A lower portion of the first extension part 13, the first folded portion 11, the first base material 16, the second base material 20, the second folded portion 15, and a lower portion of the second extension part 17 are disposed below the welded portion between the fitting tool 10 and the bag main body 40 in a state in which they are sandwiched between the film materials 42 and 44 of the bag main body 40 in a separated state. When the film materials 42 and 44 of the bag main body 40 are brought close to each other, the extension parts 13 and 17 and the film materials 42 and 44 are capable of facing each other and coming into contact with each other. The outer surfaces 16*d* and 20*d* of the base materials 16 and 20 and the inner surfaces 13*a* and 17*a* of the extension parts 13 and 17 capable of facing each other and coming into contact with each other.

When the opening portion 52 of the bag main body 40 is widened, gaps are formed between the second side end 16*b* of the first base material 16 and the first extension part 13, and between the second side end 20*b* of the second base material 20, extension part and the second extension part 17. When the user grips each of the second side end 16*b* and the second side end 20*b* by hand and moves them in the direction of separating them, the fitting between the first fitting part 18 and the second fitting part 22 is released, and the bag body 1 is opened.

Figure 7:
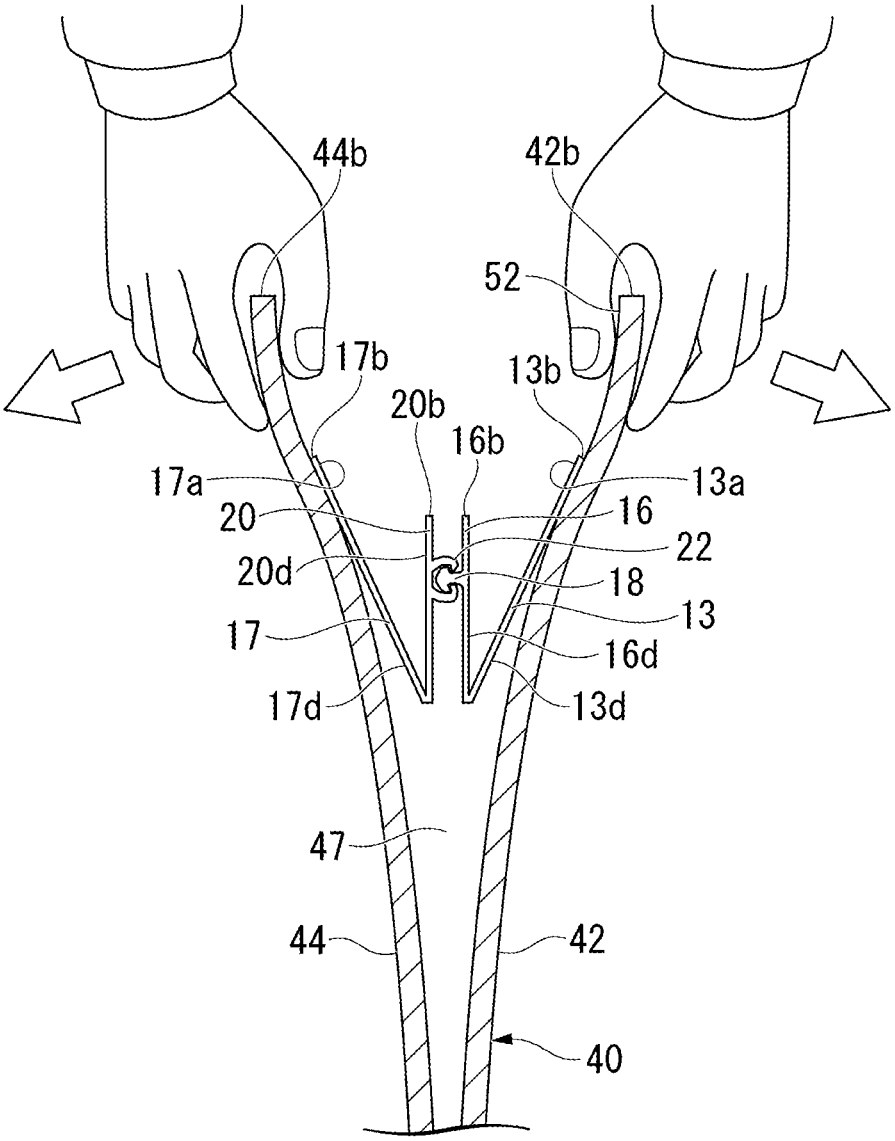
FIG. 7 is a partial cross-sectional view showing a usage mode of the bag body with the fitting tool according to the first embodiment of the present invention.

On the other hand, as shown in FIG. 7, when edge portions 42*b* and 44*b* of the film materials 42 and 44 in the vicinity of the opening portion 52 of the bag main body 40 are gripped and the film materials 42, 44 are moved in directions indicated by arrows in FIG. 7, each of the extension parts 13 and 17 are separated from the base materials 16 and 20, but the base materials 16 and 20 are not separated from each other, and the fitting state between the first fitting part 18 and the second fitting part 22 is maintained. In the fitting tool 10, when the folded portions 11 and 15 are separated from each other by a predetermined distance or more, the fitting state between the first fitting part 18 and the second fitting part 22 is released. However, as shown in FIGS. 5 and 6, both end parts of the bag main body 40 in a width direction thereof are welded, and the fitting tool 10 is provided on inner surfaces of the film materials 42 and 44 in the vicinity of the opening portion 52. For this reason, in a state in which the opening portion 52 is opened to the maximum, a state in which the first base material 16 and the second base material 20 face each other is maintained, and the fitting between the first fitting part 18 and the second fitting part 22 is not released. Therefore, even if the edge portions 42*b* and 44*b* of the film materials 42 and 44 in the vicinity of the opening portion 52 are gripped to widen the opening portion 52, the fitting between the first fitting part 18 and the second fitting part 22 is not released, and the bag body 1 cannot be opened. On the other hand, when the user grips the second side ends 16*b* and 20*b* of the base materials 16 and 20 and widens them in a direction away from each other, the fitting between the first fitting part 18 and the second fitting part 22 is released.

[Method for Manufacturing Bag Body with Fitting Tool]

A method for manufacturing the bag body 1 with the fitting tool has the following steps.

Fitting tool molding step: A resin material forming the fitting tool is supplied to an extruder, extruded by an annular die, cooled using an air cooling method or a water cooling method, and formed into a wide width film using an inflation method. As a result, the first fitting member 12 provided with the first fitting part 18, the first base material 16, and the first extension part 13 on the inner surface is formed. The second fitting member 14 is also formed in the same manner.

Fitting tool welding step: The fitting tool 10 is welded to the inner surfaces of the first film material 42 and the second film material 44. In this step, the outer surface 13*d* of the first extension end 13*b* of the first extension part 13 is welded to the inner surface of the first film material 42, and the outer surface 17*d* of the second extension end 17*b* of the second extension part 17 is welded to the inner surface of the second film material 44, at a position avoiding the first fitting part 18, the second fitting part 22, the first base material 16, and the second base material 20 by using a heating device such as a heat bar.

Fusing step: The film materials 42 and 44 after the fitting tool welding step are folded such that the first fitting part 18 and the second fitting part 22 face each other, and a base of the bag body 1 with the fitting tool is continuously formed by fusing them in the width direction at a plurality of positions at intervals in a length direction thereof.

Packaging step: The inner surfaces of the first film material 42 and the second film material 44 after cutting are made to face each other and the first film material 42 and the second film material 44 are supplied into a packaging device, and peripheral portions of the first film material 42 and the second film material 44 are heat-welded while sandwiching the contents between the first film material 42 and the second film material 44. With this step, the bag main body 40 is sealed with the contents stored in the storage portion 47.

The method for manufacturing the bag body with the fitting tool is not limited to the above-mentioned method for manufacturing the bag body with the fitting tool. For example, in the method for manufacturing the bag body with the fitting tool, a tubular body obtained in a molding step may be once wound. If necessary, a stretching step, a printing step, or the like may be carried out.

By providing the above configuration, the bag body 1 with the fitting tool described above is repeatedly opened while preventing inadvertent opening caused by an infant, a child, or the like.

According to the bag body 1 with the fitting tool according to the present embodiment, a bag body having a child resistance function in all regions of the opening portion provided with the fitting tool 10 is capable of being manufactured.

In the bag body with the fitting tool according to the present embodiment, an example in which the fitting tool 10 is welded to the first film material 42 and the second film material 44 has been described. The configuration of the bag body with the fitting is not limited to this example, and the first fitting part and the second fitting part may be directly formed on inner surfaces of film materials constituting the bag main body.

Second Embodiment

Figure 8:
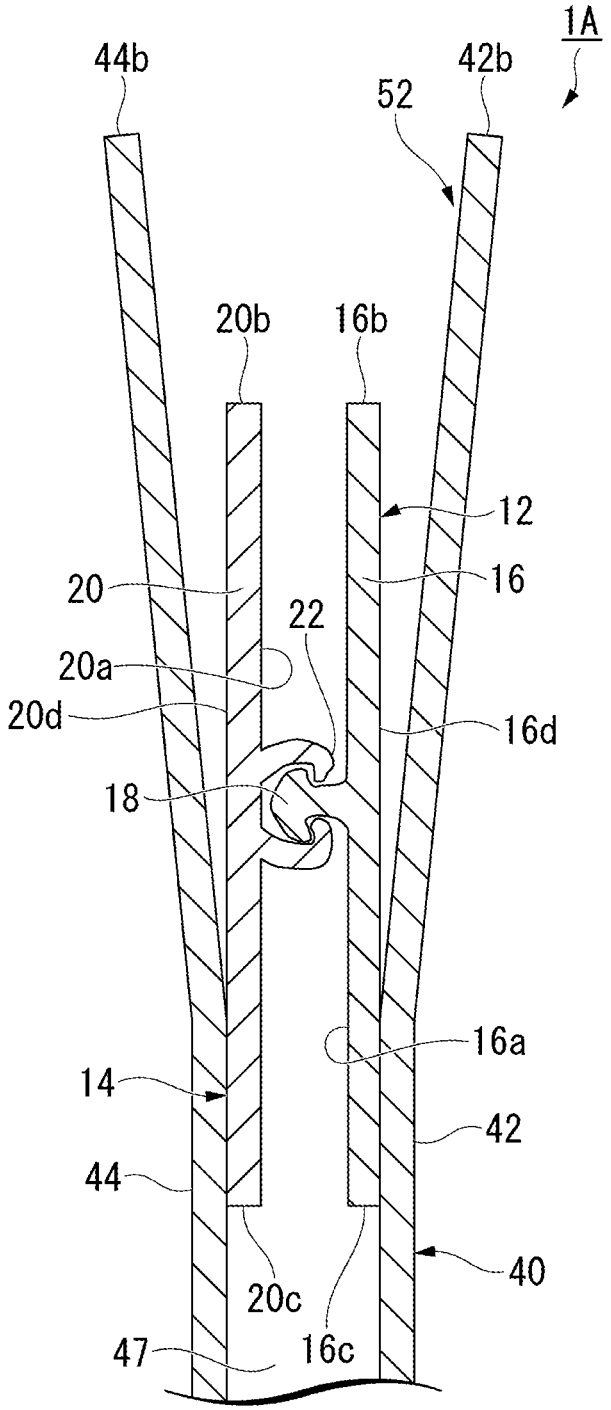
FIG. 8 is a cross-sectional view showing an opening portion of a bag body with a fitting tool according to a second embodiment of the present invention.

FIG. 8 shows a vertical cross-sectional view of the opening portion 52 of a bag body 1A with a fitting tool according to a second embodiment. In the following description, the same components as those already described in the first embodiment will be denoted by the same reference numerals, and a repeated description thereof will be omitted. The bag body 1A with the fitting tool according to the present embodiment is an example not including the folded portions shown in the first embodiment.

The configurations of the first base material 16, the second base material 20, the first fitting part 18, and the second fitting part 22 are the same as those in the first embodiment. In the bag body 1A shown in FIG. 8, the outer surface 16*d* of the first side end 16*c* of the first base material 16 is fixed to the inner surface of the first film material 42, and the outer surface 20*d* of the first side end 20*c* of the second base material 20 is fixed to the inner surface of the second film material 44. The first base material 16 and the second base material 20 are not fixed to the film materials 42 and 44 at a region from below the first fitting part 18 and the second fitting part 22 (on the storage portion 47 side) to the second side ends 16*b* and 20*b*, and the second side ends 16*b* and 20*b* (opening portion side end parts) are free ends.

In the bag body 1A with the fitting tool according to the present embodiment, similarly to the bag body 1 with the fitting tool according to the first embodiment, even when the edge portions 42*b* and 44*b* of the film materials 42 and 44 are gripped to open the opening portion 52, the fitting between the first fitting part 18 and the second fitting part 22 is not released. On the other hand, when the second side ends 16*b* and 20*b* of the base materials 16 and 20 are gripped and opened in a direction away from each other, the fitting between the first fitting part 18 and the second fitting part 22 is easily released.

According to the bag body 1A with the fitting tool according to the present embodiment, as in the first embodiment, the bag body 1A is opened repeatedly while preventing inadvertent opening caused by an infant, a child, or the like. According to the bag body 1A with the fitting tool, a bag body having a child resistance function in all regions of the opening portion provided with the fitting tool 10 is capable of being manufactured.

The bag bodies 1 and 1A with the fitting tool may be appropriately used for storing packaged items, which requires to prevent an elderly person in addition to an infant, a child, or the like to open.

In the above embodiment, the widths of the extension parts 13 and 17 are longer than the widths of the base materials 16 and 20, but dimensions of the extension parts 13 and 17 are not limited thereto. For example, in a case in which the extension ends are fixed to the inner surfaces of the bag main body using another method without using the heat-welding method, or in a case in which the widths of the base materials are sufficiently long, the widths of the extension parts and the widths of the base material may be substantially equal to each other, and the extension ends may be provided at positions substantially equal to the second ends of the base materials.

In each of the above embodiments and comparative examples, an example in which the first fitting member 12 and the second fitting member 14 have the same shape and are symmetrically disposed except for the configurations of the fitting parts 18 and 22 has been described. However, the fact that the shapes of the base materials and the extension parts are the same is not essential configuration in the first fitting member and the second fitting member. For example, the widths of the first extension part and the second extension part may be different.

Although the embodiments of the present invention have been described in detail with reference to the drawings, specific configurations are not limited to these embodiments, and include design changes and the like within a range not departing from the gist of the present invention.

Further, the components shown in the above-described embodiment and each modified example can be configured by appropriately combining them.

INDUSTRIAL APPLICABILITY

It is possible to provide a fitting tool that can be repeatedly opened while preventing inadvertent opening caused by an infant, a child, or the like, and a bag body with the fitting tool.

REFERENCE SIGNS LIST

1,1A Bag body with fitting tool
10 Fitting tool
12 First fitting member (fitting member)
13 First extension part (extension part)
13*b* First extension end (extension end)
14 Second fitting member (fitting member)
16 First base material (base material)
16*b* Second side end (second end part)
16*c* First side end (first end part)
17 Second extension end (extension end)
17*b* Second extension end (extension end)
18 First fitting part (fitting part)
20 Second base material (base material)
22 Second fitting part (fitting part)
40 Bag main body
47 Storage portion
52 Opening portion

The invention claimed is:

1. A bag body with a fitting tool comprising:

a bag main body which includes a storage portion for storing contents, a first film material including a first edge portion adjacent an opening of the bag main body and a second film material including a second edge portion adjacent the opening of the bag main body; and the fitting tool attached to an inner surface of the bag main body in a vicinity of the opening portion of the bag main body, wherein the fitting tool comprises:

a first base material and a second base material which have a strip-shape;

a first fitting part provided on the first base material in a longitudinal direction of a first fitting member;

a second fitting part provided on the second base material in a longitudinal direction of a second fitting member, the second fitting part being detachably fitted to the first fitting part;

a first extension part that extends from a first end part in a width direction of the first base material toward an outer surface side opposite to a first facing surface, on which the first fitting part is provided, the first extension part facing to the outer surface of the first base material;

a second extension part that extends from a first end part in a width direction of the second base material toward an outer surface side opposite to a second facing surface, on which the second fitting part is provided, the second extension part facing to the outer surface of the second base material;

a first folded portion folded at a boundary part between the first extension part and the first base material;

a second folded portion folded at a boundary part between the second extension part and the second base material, wherein in each of the first base material and the second base material, a second end part is located on a side opposite to the first end part and is separated from each of the first extension part and the second extension part, wherein at least a part of the first extension part and at least a part of the second extension part are fixed to the inner surface of the bag main body, wherein each of the second end part is provided on an opening portion side of the bag main body with respect to the first end part, wherein, in a first state, the first fitting part and the second fitting part are detachably fitted, a first extension end of the first extension part and a second extension end of the second extension part are spaced apart a first distance, and a first angle is formed by the first base material and the first extension part at the first folded portion and a first angle is formed by the second base material and the second extension part at the second folded portion, and wherein, in a second state, the first fitting part and the second fitting part are detachably fitted, the first extension end of the first extension part and the second extension end of the second extension part are spaced apart a second distance greater than the first distance, and a second angle is formed by the first base material and the first extension part at the first folded portion that is greater than the first angle formed in the first state by the first base material and the first extension part at the first folded portion and a second angle is formed by the second base material and the second extension part at the second folded portion that is greater than the first angle formed by the second base material and the second extension part at the second folded portion in the first state; and in the first state and in the second state, the second end parts in the first and second base materials are positioned between the first and second fitting parts and the opening portion of the bag main body in the width direction of the first base material and the second base material.

2. The bag body with the fitting tool according to claim 1, wherein the first extension part and the second extension part extend toward the opening portion side with respect to the second end parts, the first extension end of the first extension part and the second extension end of the second extension part are fixed to the inner surface of the bag main body, regions other than the first extension end and the second extension end of the fitting tool are separated from the inner surface of the bag main body, and the first end parts of the fitting tool are separable from the inner surface of the bag main body.

3. The bag body with the fitting tool according to claim 1, wherein the first extension is welded to the main bag body.

4. The bag body with the fitting tool according to claim 1, wherein the second extension is welded to the main bag body.

5. The bag body with the fitting tool according to claim 1, wherein the at least a part of the first extension part is fixed to the first film material below the first edge portion of the first film material and at least a part of the second extension part is fixed to the second film material below the second edge portion.

* * * * *